US006662950B1

(12) United States Patent
Cleaver

(10) Patent No.: US 6,662,950 B1
(45) Date of Patent: Dec. 16, 2003

(54) WAFER SHIPPING AND STORAGE CONTAINER

(76) Inventor: Brian R. Cleaver, 41440 Christy St., Fremont, CA (US) 94538

( * ) Notice: Subject to any disclaimer, the term of this patent is extended or adjusted under 35 U.S.C. 154(b) by 0 days.

(21) Appl. No.: 09/427,199

(22) Filed: Oct. 25, 1999

(51) Int. Cl.[7] ..... B65D 85/00

(52) U.S. Cl. ..... 206/710; 206/454; 206/1.5; 206/508; 211/41.18

(58) Field of Search ..... 206/523, 454, 206/449, 303, 1.5, 508, 509, 511, 710, 521, 712; 211/41.17, 41.18; 118/500; 220/665, 297, 300, 293, 4.21, 4.24, 4.25, 54, 506, 918

(56) References Cited

U.S. PATENT DOCUMENTS 1,546,312 A * 7/1925 Patton et al. ..... 220/918
1,720,327 A * 9/1929 Halvorson ..... 220/918
3,759,416 A * 9/1973 Constantine ..... 206/505
3,918,581 A * 11/1975 Scammon, Jr. et al. ..... 206/523
3,992,811 A * 11/1976 Yellin ..... 220/23.83
4,405,057 A * 9/1983 Stein ..... 220/523
4,588,086 A * 5/1986 Coe ..... 206/309
4,787,508 A * 11/1988 Wu et al. ..... 206/445
4,844,263 A * 7/1989 Hadtke ..... 206/508
4,874,088 A * 10/1989 Leben ..... 206/509
5,025,926 A * 6/1991 Gregerson et al. ..... 206/711
5,040,678 A * 8/1991 Lenmark, Sr. et al. ..... 206/443
5,553,711 A * 9/1996 Lin et al. ..... 206/710
5,641,090 A * 6/1997 Kowalski et al. ..... 220/782
5,699,925 A * 12/1997 Petruzzi ..... 220/4.27
5,724,748 A * 3/1998 Brooks et al. ..... 206/454
5,775,508 A * 7/1998 Bongard et al. ..... 206/711
5,947,318 A * 9/1999 Palm ..... 220/297
5,984,130 A * 11/1999 Hayes et al. ..... 220/574
6,119,865 A 9/2000 Kawada
6,286,684 B1 9/2001 Brooks et al.
6,533,123 B1 3/2003 Nakamura et al.

* cited by examiner

*Primary Examiner*—Shian Luong
(74) *Attorney, Agent, or Firm*—Gregory Scott Smith; Gregory Smith & Associates

(57) ABSTRACT

The present invention is shipping and storage container for storing and transporting a plurality of disc shaped objects, such as wafers and the like, while protecting the items from vibration, abrasion, impact, particulation, static electricity, and outgassing. Although the carrier of the present invention may be configured to carry many kinds of thin disc shaped objects, the invention is particularly suited for safely storing and transporting wafers. In its broadest sense, the shipping container of the invention comprises a separable base and cover. The base is configured to hold a plurality of wafers stacked one on top of the other within a cylindrical storage area. The upper wafers are supported by wafers below, and ultimately by the flat bottom of the container. The cover is configured to fit over portions of the base to enclose the stored wafers. The base and cover may include a number of useful features including tamper seals, locking means, data storage devices for readably storing data regarding the contents of the carrier, features for allowing the stable stacking of multiple containers, and features for use by robots or automated equipment to manipulate the container or to load and unload disks.

20 Claims, 7 Drawing Sheets

WAFER SHIPPING AND STORAGE CONTAINER

FIELD OF THE INVENTION

This invention relates generally to a carrier box assembly for storing and transporting a plurality of thin flat objects including masks, displays, hard disks, silicon wafers and the like, and more particularly for the storage and transport of a plurality of semiconductor wafers.

BACKGROUND OF THE INVENTION

Various prior art containers have been used in the electronics industry to transport masks, displays, disks, and wafers. The high value and fragile nature of such items requires a very reliable means for supporting them within the container. Many containers are configured specifically for the storage of semiconductor wafers because they are particularly valuable and fragile.

Semiconductor wafers are generally circular in shape and very thin. During the wafer manufacturing process, it is often necessary or desirable to move partially completed wafers from a first manufacturing facility to a second manufacturing facility for completion. This requires that the wafers be removed from the first production assembly, then packed and shipped to the second facility, where they are unloaded for further processing, without causing any damage to the wafer. Sources of damage include, but are not limited to, vibration, scraping, or impact during shipping, contamination of the wafer surface, or the destruction of printed circuitry by static electricity.

In the past, the handling of wafers by the edges has been preferred in order to prevent damage to, or contamination of, the surface of the wafer. Consequently, known semiconductor wafer carriers have generally stored wafers in stacked cassettes supporting the wafers only at the edges.

A continuing trend in the electronics industry is the ever increasing size, and decreasing thickness, of the wafers that must be stored and shipped. As the size and corresponding surface area of the disks increases, and as the thickness of the wafers decreases, new techniques must be found to protect them from damage. The use of rigid supports on the edges of the wafers (prevalent in prior containers) is not sufficiently effective in protecting these larger more delicate wafers. Furthermore, many prior shipping containers have not been well adapted for handling by robotic or automated machinery, thus requiring manual intervention at various stages for loading and unloading. In the processing of semiconductor wafers, there is an inverse relationship between chip yield and particle contamination. Every step requiring manual handling of the wafers increases contamination problems. Concern for particle contamination has increased as chip circuit geometries have decreased, because of the increased potential for contamination by ever smaller particles.

What is needed is a wafer carrier that fully supports the wafer in order to avoid damage to the wafer, that protects from the buildup of static charge, that is less expensive to manufacture than previous container designs, and that is configured to allow robotic handling of the carrier, and robotic manipulation of wafer.

SUMMARY OF THE INVENTION

Accordingly, the present invention is a shipping and storage container for storing and transporting a plurality of disc shaped objects, such as wafers and the like, while preferably protecting the items from vibration, abrasion, impact, particulation, static electricity, and outgassing. Although the embodiments described in this application are configured for holding wafers, the invention could be easily modified by one of ordinary skill for storing other materials including, hard disks, photomasks, liquid crystal displays, flat panel displays, and the like.

In its broadest sense, the invention comprises a separable base configured to hold a plurality of wafers stacked one on top of the other within a cylindrical storage area, and a cover configured to fit over portions of the base to enclose the stored wafers. More specifically, the carrier of the invention comprises a base with a deck having at least one wall defining the roughly cylindrical storage area, and a cover including a cylindrical recess or lid configured to fit over and around the vertical wall of the base.

In some embodiments, the base of the container includes four roughly identical walls with gaps between the ends of each wall. In other embodiments, these walls are hollow and may be used for holding desiccants, preferably in sealed packages. In various embodiments, the container of the invention also includes a number of useful features, including features used to allow handling of both the container and the wafers by robots or automated machinery, a tamperproof seal, a locking means to prevent accidental opening of the container, stiffening ridges, and data storage means for storing data regarding the contents of the containers. In one embodiment, the locking means is a locking assembly including at least one guide ridge and riser formed on the outer perimeter of one or more vertical walls of the base, and at least one corresponding locking tab formed on the inside surface of the cylindrical recess of the lid.

In use, the wafers are placed in vertical stacks within the cylindrical storage area defined by the vertical walls of the base, with lower wafers supporting the underside of upper wafers. Preferably, a protective material, including but not limited to cellulose, a flash-spun and heat-bonded high-density polyethylene (HDPE) fabric that is sold under the tradename a flash-spun and heat-bonded high-density polyethylene (HDPE) fabric that is sold under the tradename TYVEK, or foam discs, are placed between each pair of adjacent wafers. Furthermore, a layer of compressible material is preferably positioned between the top wafer and an underside of the lid. The compressible material fills any void left between the top of the stack and the underside of the lid. It is preferable to overfill the container with the compressive material, so that the overfill creates light compression on the wafers when the container cover is placed over the base, which tends to inhibit wafer movement inside the container, tending to reduce wafer damage.

DETAILED DESCRIPTION OF THE INVENTION

The present invention is a shipping and storage container for storing and transporting a plurality of disc shaped objects, such as wafers and the like, while preferably protecting the items from vibration, abrasion, impact, particulation, static electricity, and outgassing. In its broadest sense, the wafer shipping container of the invention comprises a separable base configured to hold a plurality of wafers stacked one on top of the other within a cylindrical storage area, and a cover configured to fit over portions of the base to enclose the stored wafers.

The container of the invention departs from the majority of the prior designs by stacking the wafers in vertical stacks with lower wafers supporting upper wafers. Prior containers typically support the wafers only by the edges of the wafers. A detailed description of several exemplary embodiments of the invention will now be made with reference to the FIGS. 1 through 11, and wherein like features are identified by like numbers. Although the embodiments described herein are configured for holding wafers, the invention could be easily modified by one of ordinary skill for storing other materials including, hard disks, photomasks, liquid crystal displays, flat panel displays, or other items could also be shipped using this system.

Figure 1:
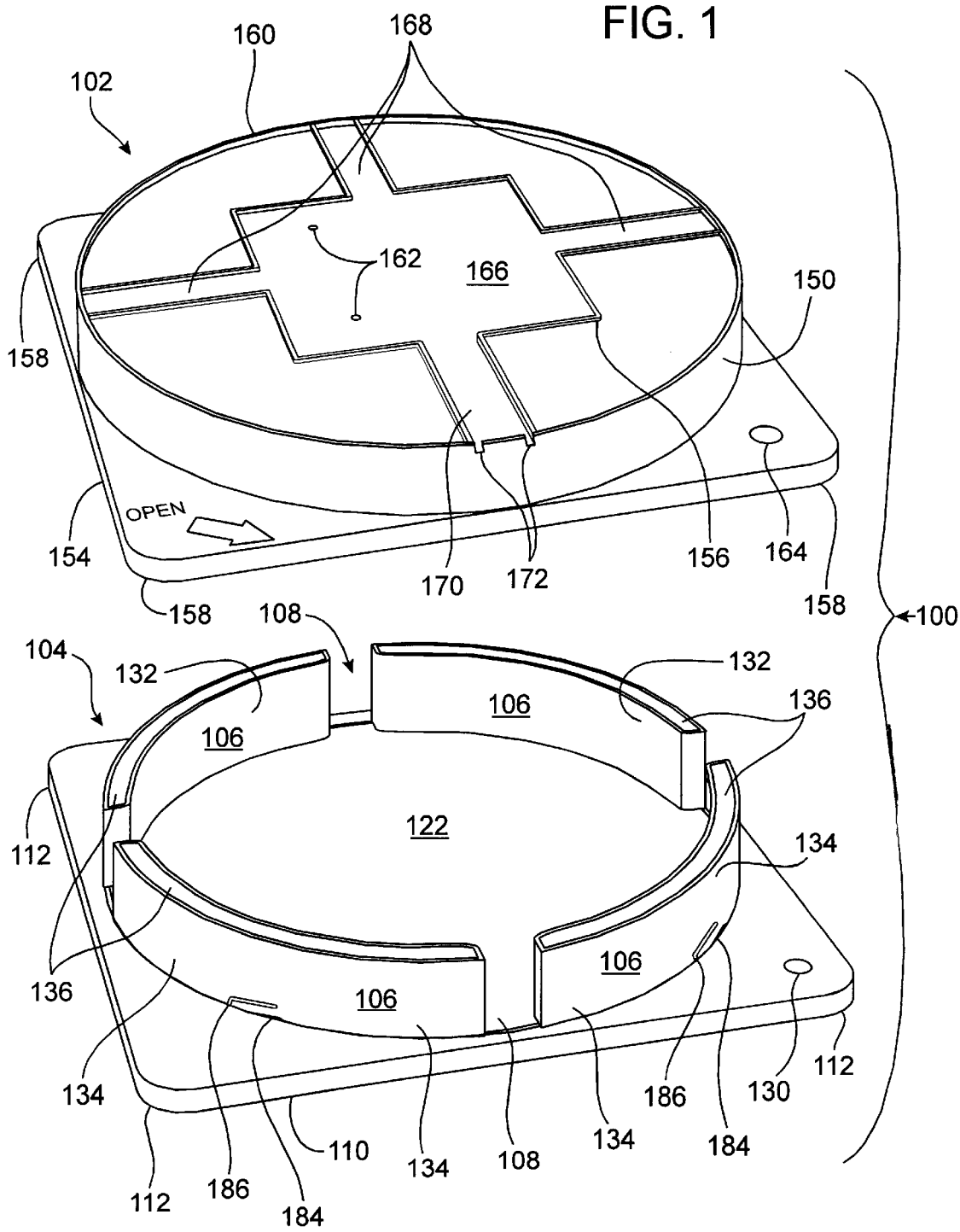
FIG. 1 is a perspective view of an embodiment of the container of the invention showing the cover of the carrier separated from the base of the carrier.
Figure 2:
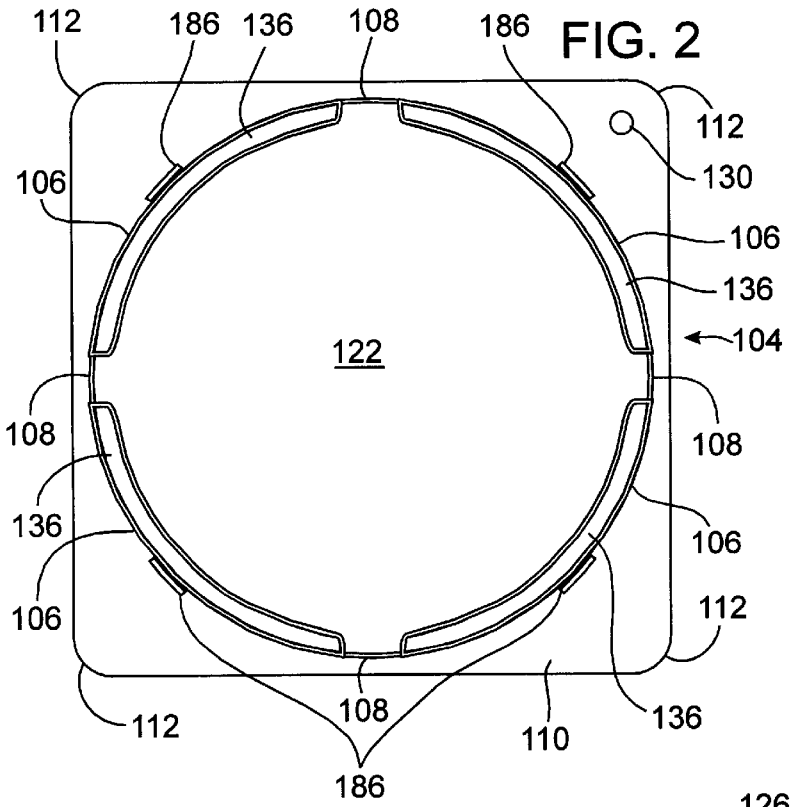
FIG. 2 is a top view of the base of the container of FIG. 1.

FIG. 1 shows a perspective view of a first embodiment of the container of the invention, generally referenced by the number 100. The invention comprises an upper portion or cover 102 and a matching lower portion or base 104. The base 104 comprises a rectangular deck 110 preferably with a least one wall defining a cylindrical wafer storage area. The wall preferably includes at least one gap, and more preferably, as seen in FIGS. 1 and 2, four vertical walls 106 with a gaps 108 between each pair of walls 106. Preferred dimensions will be provided for an embodiment of the container 100 of the invention configured to carry an 8 inch wafer, however, the container 100 could be easily modified by one skilled in the art to accommodate other wafer sizes by scaling the dimensions accordingly.

Figure 3:
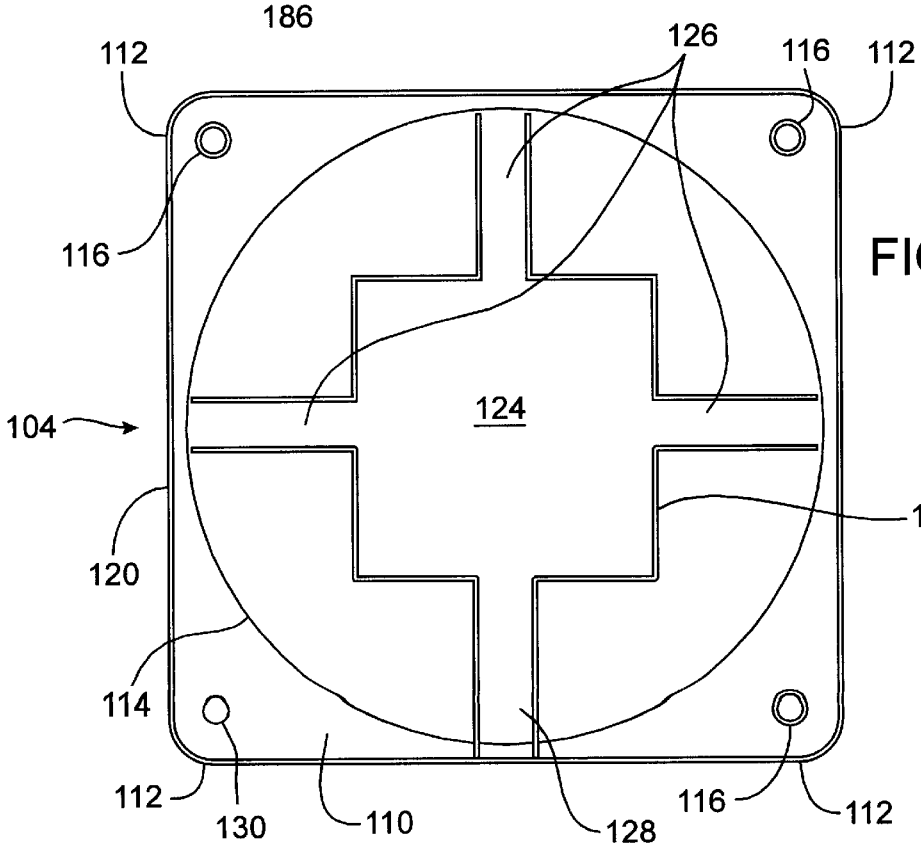
FIG. 3 is a bottom view of the base of FIG. 2.

Referring to FIG. 3, which shows a bottom view of the base 104, the deck 110 is preferably square with rounded corners 112, although any other desired or practical shape may be used. The deck 110 further includes a number of features formed in the bottom surface of the deck 110 including a peripheral flange 120, a raised cylindrical structure 114, gripping structures 116, and raised ridges 118 forming a cross shape with a center square. In alternate embodiments, one or more additional features may be added or one or more of the listed features may be eliminated.

The preferred length and width of the deck 110 is approximately 9 5/16 inches square, and the preferred radius of the rounded corners 112 are preferably approximately 1 1/8 inch, although the actual dimensions of the deck 110 and the radius of the rounded corners 112 may be modified as needed or desired. The peripheral flange 120 is formed around the edges of the deck 110. In some embodiments, the dimensions of the peripheral flange 120 may be configured specifically for use by robots or automated machinery to manipulate the container 100. In any case, the dimensions of the peripheral flange 120 are preferably at least adequate to provide rigidity to the edges of the deck 110. In the embodiment shown in FIG. 3, the height of the peripheral flange 120 from the adjacent bottom surface of the deck 110 is preferably approximately 1/4 inch, and the width of the peripheral flange 120 is preferably approximately 1/16.

The raised cylindrical structure 114, which corresponds to a cylindrical depression 122 on the upper surface of the base 104 of the deck 110, is preferably formed roughly in the center of the deck 110, and preferably has a diameter of approximately 9 inches. The height of the raised cylindrical structure 114 is preferably slightly less than the height of the peripheral flange 120, but alternate embodiments could be configured otherwise.

Gripping structures 116 are formed near three of the four rounded corners 112 of the deck 110 to provide convenient locations for grasping and handling by machinery or robots. In the preferred embodiment shown in FIG. 3, the gripping structures 116 are preferably circular or "0" shaped with an exterior diameter of approximately 1/2 inch, and an interior diameter of approximately 1/16 inch. However, the particular configuration or shape of the gripping structure 116 may be adapted as necessary to accommodate the machinery or robots that may be used to manipulate the container 100. Thus, in alternate embodiments, the gripping structures 116 may be virtually any useful shape and size, and may also be positioned in alternative locations.

Figure 4:
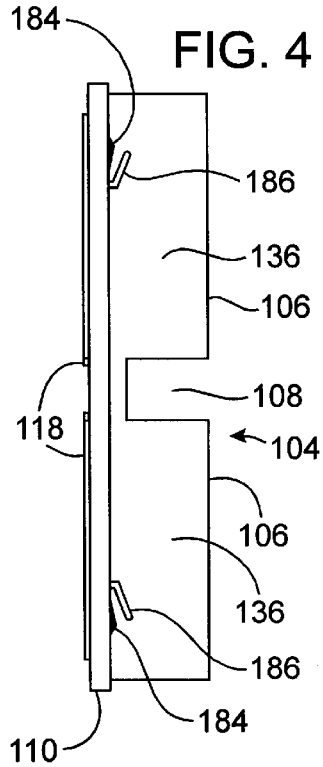
FIG. 4 is a side view of the base of FIG. 2.

Referring still to FIG. 3, a pattern of raised ridges 118 form a cross pattern on the surface of the raised cylindrical structure 114, with a center square 124 from which extend three narrow arms 126, and one wide arm 128. The ridges 118 preferably perform at least one of the following functions: (1) the ridges 118 may help stiffen the deck 110 of the container 100, (2) the ridges 118 may be configured to interlink with similar ridges formed on the top of the cover 102 for stability when multiple containers 100 are stacked, and (3) the ridges may be used by robotic or automated machinery to manipulate the container 100, and (4) the square 124 formed by the ridges 118 may, when interlinked with a similar pattern on the lid of an adjacent stacked container 100, define a protected area used to store a floppy disk or other data storage media containing information relating to the contents of the container 100. In the embodiment seen in FIG. 3, the ridges 118 are preferably approximately 1/16 inch in width, and approximately 1/16 inch in height. The center square 124 is preferably 4 and 3/16 inches square. The narrow arms 126 of the cross pattern are defined by two parallel ridges with an approximately 1/2 inch wide gap between them. The wide arm 128 is defined by two parallel ridges with an approximately 7/8ths inch gap between them. The ridges of the narrow arms 126 preferably end somewhat short of an edge of the raised cylindrical structure 114, whereas the ridges of the wide arm 128 preferably extend to all the way to the peripheral flange 120. Referring to FIG. 4, which is a side view of the Base 104 of FIG. 2, the raised ridges 118 extend beyond a plane formed by the peripheral flange 120. Thus, when sitting on a flat surface, the deck 110 rests upon the raised ridges 118 rather than on the peripheral flange 120. In alternate embodiments the dimensions and pattern of ridges 118 may be modified as desired, for example, to provide additional or different functional benefit or a different decorative appearance.

The corner of the deck 110 that lacks a gripping feature 116 includes, instead, an aperture 130. As will be discussed in more detail below, when the cover 102 is positioned over the base 104 and rotated into place, the aperture 130 of the deck 110 will align with a matching aperture in the cover 102.

Referring to FIG. 2, the top of the base 104 preferably includes four substantially similar walls 106 formed on the upper surface of the deck 110 of the base 104 at least partially within the cylindrical depression 122. The walls 106 each have an inner side 132 that, together, define a cylindrical storage region that is preferably approximately 8 inches in diameter. The walls 106 also each have a thickness a height, and an outer side 134. The outer sides 134 of the walls 106 together define an outer circumference with a diameter of approximately 9 inches. The height of the walls measure approximately 1 ½ inches from the bottom of the cylindrical depression 122 to the top of the walls 106, and approximately 1 5/16 from the top of the deck 110 to the top of the walls 106.

In the embodiment shown in FIGS. 1, 2, and 3, the walls 106 are hollow, forming a chamber 136 within each wall 106. The wall chambers 136 reduce the amount of material used in the construction of the base, which reduces cost and lightens the container 100. The chambers 136 can also be used to store desiccants, preferably in pouches, intended to keep the stored wafers dry. The possible or useable size and configuration of the chambers 136 are limited only by the dimensions of the walls 106.

The access gaps 108 are preferably formed between adjacent walls 106. In some embodiments, the gaps 108 may be required to allow access by a robotic arm or automated machinery to manipulate the wafers (not shown) and any associated packing within the storage area defined by the walls 106. In use, the preferred robotic arm will gently contact the upper surface of the top wafer with a rubber cup, and use a vacuum formed against the surface of the wafer under the upper cup to lift the disk. The width of the gaps 108 are preferably approximately 1 inch.

Figure 8:
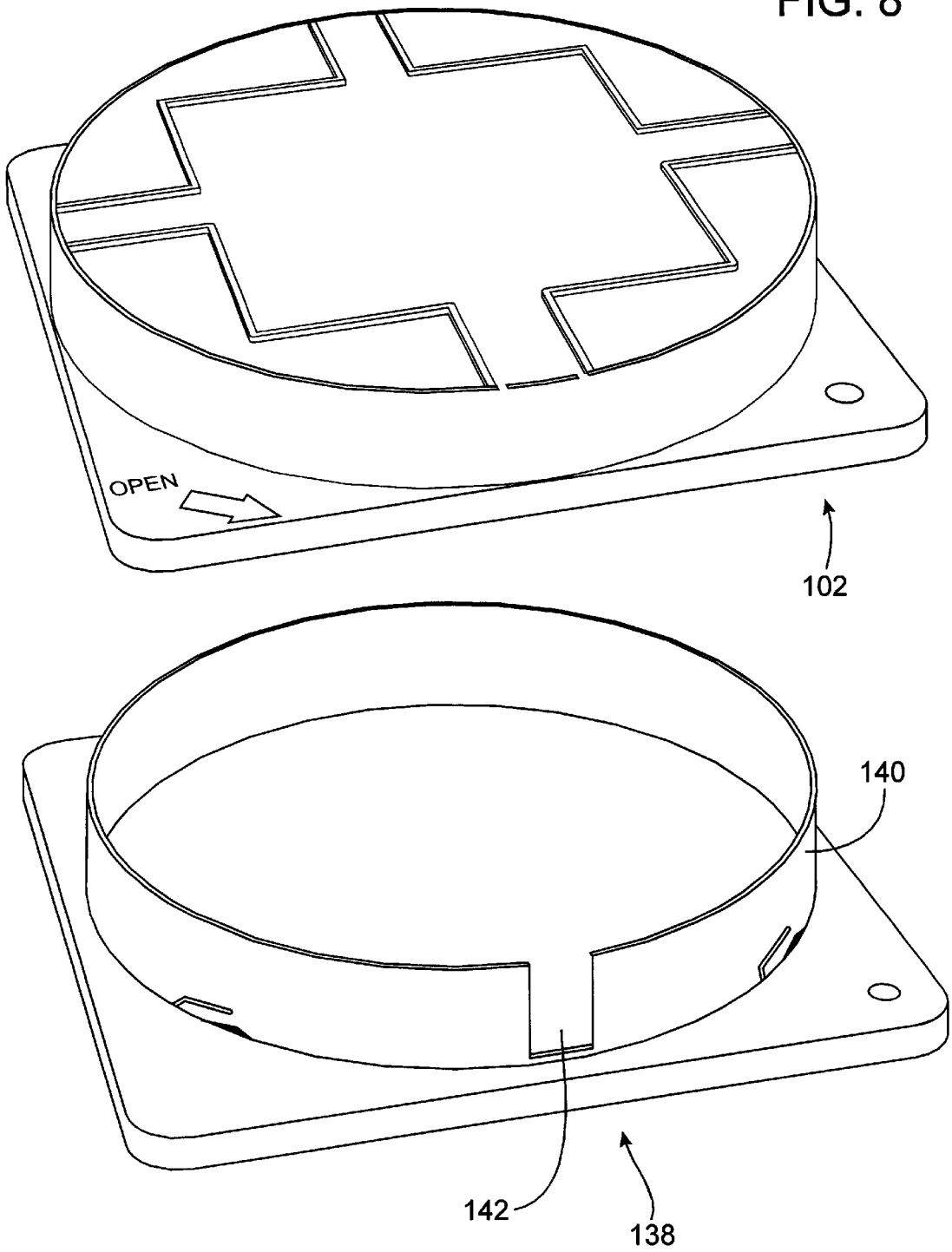
FIG. 8 is a perspective view of an alternate embodiment of the container of the invention with the base comprising only a single vertical wall.

In alternate embodiments, the number of walls 106 and the configuration and dimensions of the walls 106 may be modified as desired. For example, FIG. 8 shows a perspective view of another embodiment of the a container of the invention with a base 138 having only a single thin wall 140, with no wall chamber, and only a single access gap 142. Some alternate embodiments may not require any access gaps at all, and still other embodiments may be configured with more or differently sized and shaped access gaps as required to accommodate selected robotic or automated machinery.

Figure 5:
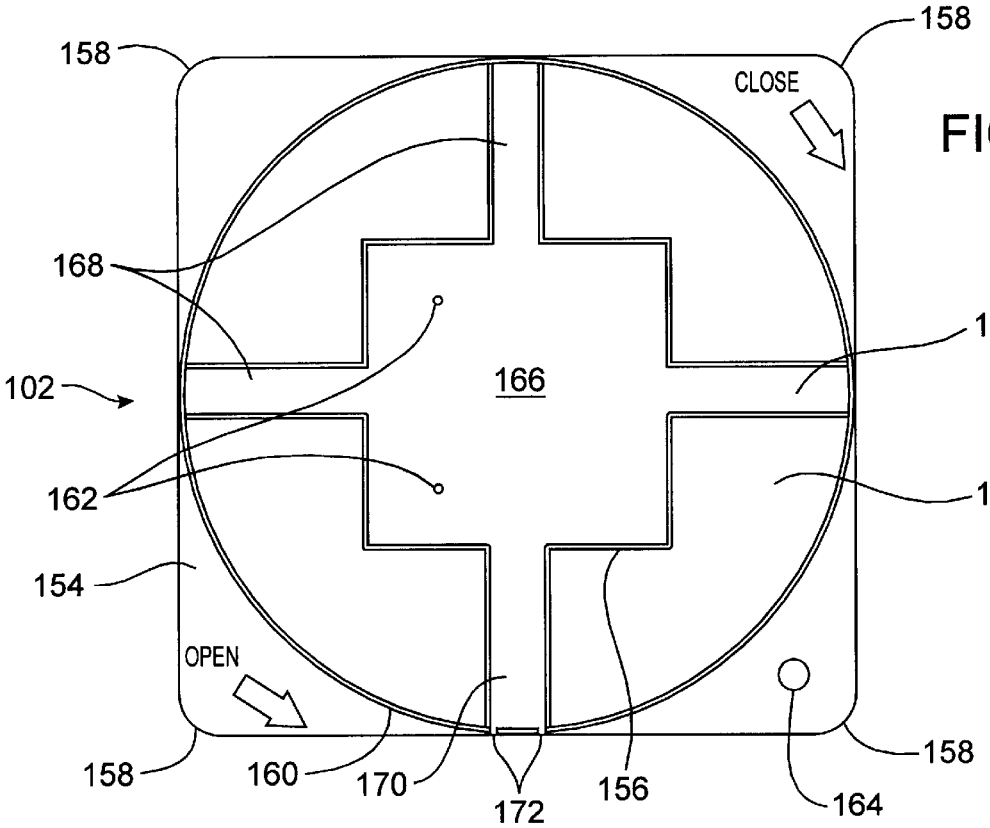
FIG. 5 is top view of the cover of the container of FIG. 1.
Figure 6:
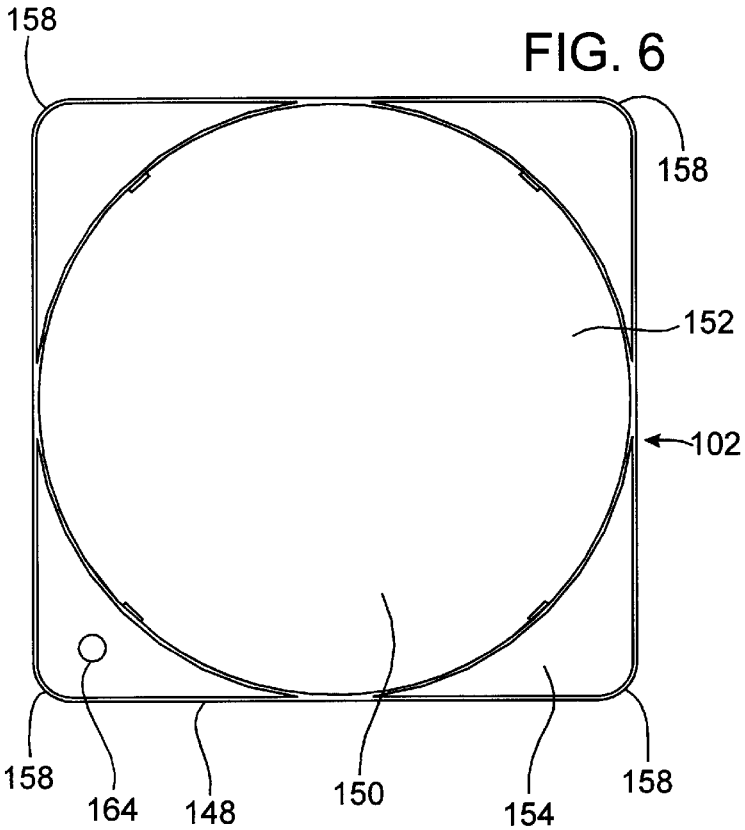
FIG. 6 is a bottom view of the cover of FIG. 5.
Figure 7:
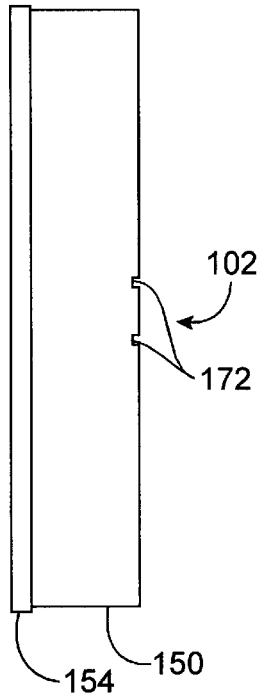
FIG. 7 is a side view of the cover of FIG. 6.

Referring to FIGS. 5, 6, and 7, the cover 102 preferably comprises a cylindrical recess 152 that defines a cylindrical lid 150 to receive the walls 106 of the base 104. The cover further preferably comprises a square flange 154, with rounded corners 158, formed around the lower edge of the lid 150. The preferred length and width of the flange 154 is approximately 9 5/16 inches square, and the preferred radius of the rounded corners 112 are preferably approximately 1 ⅛ inch. Any other desired or practical shape for flange 154 may be used, but the shape should preferably be similar to that of the deck 110 of the base 104. The diameter of the cylindrical recess 152 is somewhat larger than the circumference defined by the outer peripheral surfaces of the walls 106 of the base 104. The top surface of the cover 102 preferably includes a number of useful features including a pattern of raised ridges 156 forming a cross pattern with a center square and four arms, three narrow arms 168 and one wide arm 170, preferably corresponding the similar design formed on the bottom of the base 104. The top surface of the cover 12 preferably also includes a peripheral ridge 160 running around the top of the lid 150, gripping structures 162 formed on the upper surface of the lid 150 for gripping a data storage medium, and a locking aperture 164 that corresponds to the locking aperture 130 of the deck 110 of the base 104. However, in alternate embodiments, one or more additional features may be added or one or more of the features may be eliminated.

The peripheral ridge 160 is preferably taller than the ridges 156, and runs around the top of the cylindrical lid 150 as shown in FIG. 5. A pair of alignment notches, best seen in FIG. 7 which is a side view of the cover of FIG. 5, are formed in the peripheral ridge between the ridges of wide arm 170 of the cover 102. The alignment notches 172 correspond to the ridges of the wide arm 128 of the base 104. Preferably the stacked containers 100 of the invention will seat properly only when the ridges 118 of the wide arm 128 of the base 104 are aligned with the alignment notches 172 in the top of the container below. The diameter of the peripheral ridge 160 is preferably slightly larger than the diameter of the raised cylindrical structure 114 on the bottom of the base 104 because the circle defined by the peripheral ridge 160 on the lid 150 of the cover 102 is sized to accept the raised cylindrical structure 114 when the containers 100 are stacked.

Like the raised pattern of ridges on the bottom surface of the deck 110 of the base 104, the raised ridges 156 on the top of the cylindrical lid 150 preferably perform at least one of the following functions: (1) the ridges may add additional stiffness of the top of the cover 102, (2) the ridges may be configured to interlink with similar ridges formed on the bottom of the base 104 of the lower portion when multiple units are stacked, (3) the ridges may be used by robotic or automated machinery to manipulate the container 100, and (4) the ridges 156 may, when interlinked with a similar pattern on the lid of an adjacent stacked container 100, define a protected area used to store a floppy disk or other data storage media containing information relating to the contents of the container 100.

The ridges are preferably approximately 1/16 inch in width, and approximately 1/16 inch in height. The center square 166 measures, preferably, 4 5/16 inches square. The narrow arms 168 of the cross pattern are defined by two parallel ridges with a gap of approximately 9/16 inch, the wide arm 168 is defined by two parallel ridges with a gap of approximately 1 a 1/16th inches. Referring to FIG. 7, the raised ridges 156 are less than or equal to the height of a plane defined by the top of the peripheral ridge 160. In alternate embodiments the dimensions and pattern of ridges 156 may be modified as desired, for example, to provide additional or different functional benefit or a different decorative appearance.

Referring again to FIG. 5, the center square 166 formed by the raised ridges 156 on the top of the lid 150 also preferably includes gripping features or locations for holding a selected data storage medium such as a floppy disc, CD ROM, transponder, magnetic strip, bar code, or other storage media. In the preferred embodiment of the cover 102 seen in FIGS. 1 and 5, the gripping structures 162 comprise a pair of pins positioned to snap into the write protect holes on a standard floppy disc. The disc may be used to record the contents of the container, or to transmit other desired data relating to the contents of the containers.

As previously mentioned, apertures 130 and 164 are formed in the deck 110 of the base 104 and the flange of the cover 102, respectively. Together, the apertures 130 and 164, when aligned, form a hole extending through both the flange 154 of the cover 102 and the deck 110 of the base 104 to accept a portion of a locking apparatus or tamper indicator or tamper proof seal. The preferred tamper indicator comprises a seal that must be destroyed in order to open the container 100. Acceptable tamper indicators include, but are not limited to, dual sided locking pins showing the logo of the customer, color coded pins, tie wraps, wax seals and metal seals.

Figure 9:
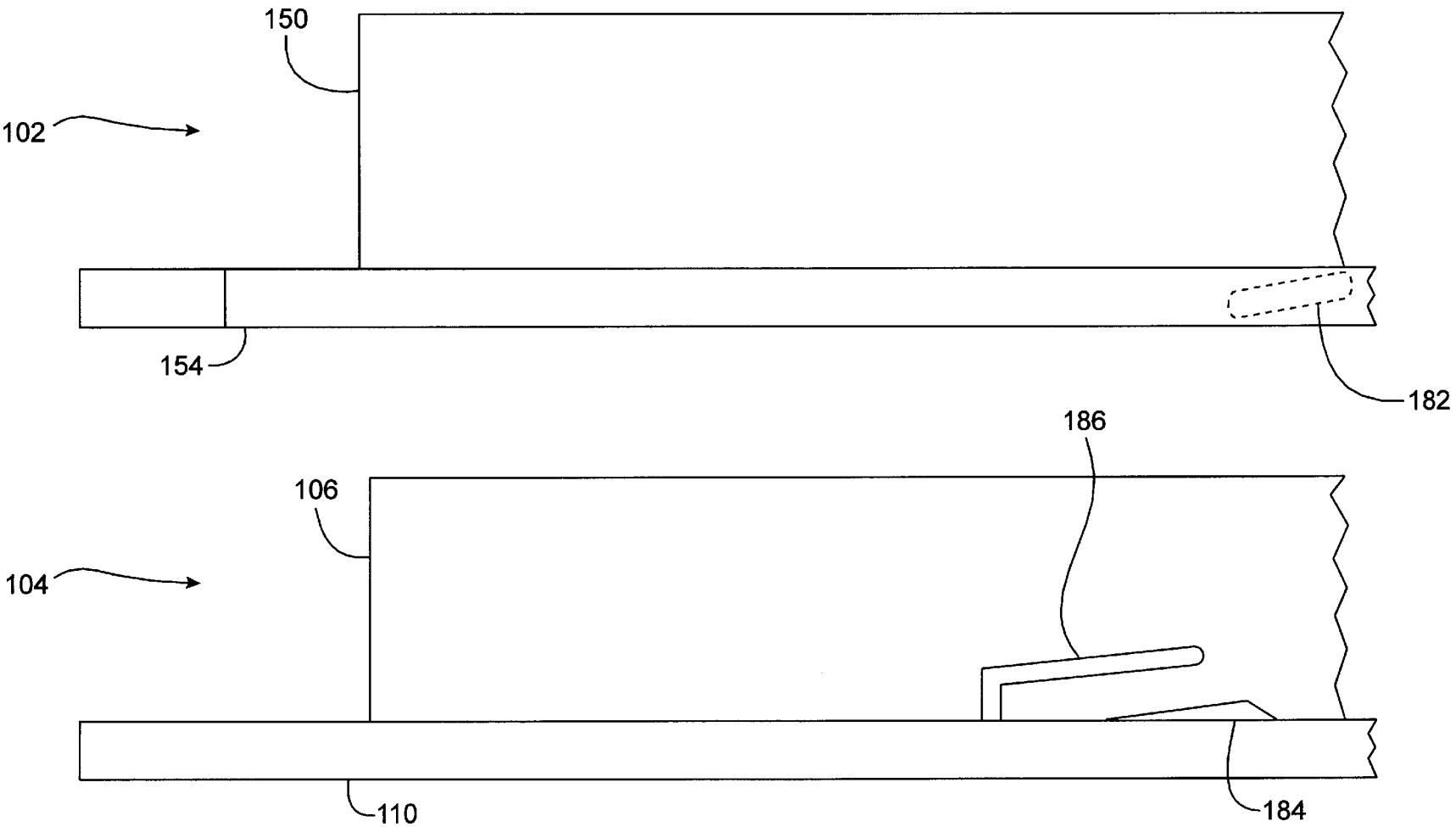
FIG. 9 is a side view of the base and cover of the container of FIG. 1, showing a cam and lock mechanism with the cover rotated, relative to the base, into position to begin closing the container.
Figure 10:
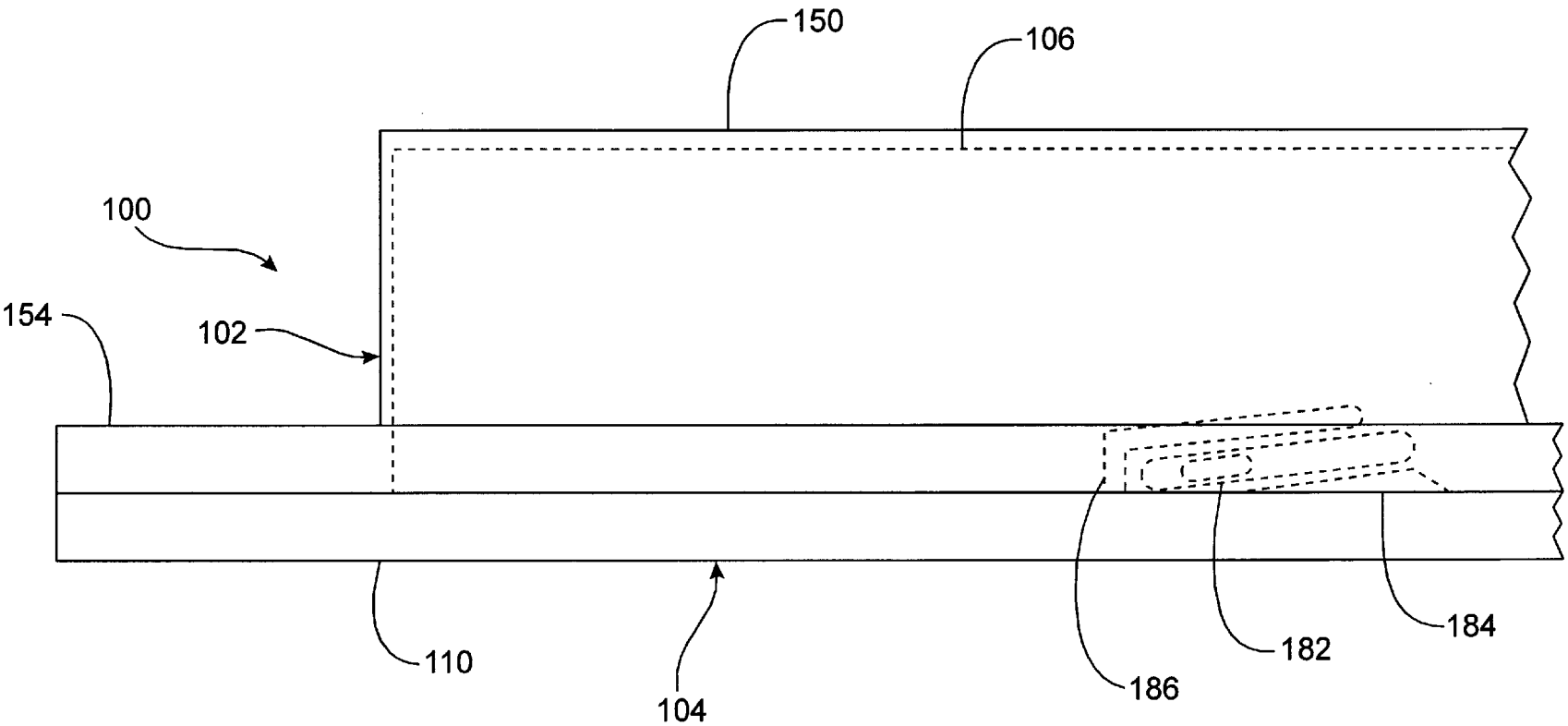
FIG. 10 is a side view of the base and cover of container of FIG. 9 after the cover and base have been rotated into the closed position.

In a preferred embodiment, the container includes four equally spaced locking elements 187 for preventing or resisting the inadvertent separation of the cover 102 from the base 104 during use. Each locking element 187 comprises a locking tab 182 formed on the inside wall of the cylindrical recess 152, which interacts with a riser 184 and a guide ridge 186 on the outer surface of the walls 106 of the base 104. The features can be more clearly seen in FIGS. 9 and 10, which show a side view of a portion of a container with one locking tab interacting with a guide ridge 186 and riser 184. Referring to FIG. 9, the cover 102 is shown separated from the base 104, but with the cover 102 rotated relative to the base 104 so that the guide ridge 186 and riser 184 and the locking tab 182 are positioned properly relative to each other to begin the process of closing the container 100. The cover 102 is lowered over the base 104 until the lower surface of the flanges of the cover 102 rests against the upper surface of the deck 110 of the base 104. The cover 102 is then rotated relative to the base 104 so that the locking tab 182 is turned into contact with the riser 184. The locking tab 182 contacts the leading edge of the riser 184 and lifts the cover 102 slightly as the locking tab 182 moves over the riser 184. The locking tab 182 then slides down the slope of the riser 184 until the locking tab 182 contacts the vertical portion of the guide ridge 186. The guide ridge 186 guides the locking tab 182 downward towards the deck 110 of the base 104, and acts to stop the locking tab 182 from rotating further. Once closed, the guide ridge 186 also prevents the locking tab 182 from moving upward relative to the base 104 unless the cover 102 is rotated in the opposite direction. When the cover 102 is rotated in the opposite direction, the riser 186 contacts the locking tab and causes the locking tab 182, and thus the cover 102, to lift away from the base 104. This facilitates removal of the cover 102 from the base 104, and prevents twisting and scuffing of the wafers 192 caused by the rotation of the cover 102. All four locking elements 187 are moved into locking position simultaneously as the cover 102 is rotated relative to base 104. In alternate embodiments, any other known locking means may be used.

The material used to form the container 100 is preferably selected to provide a chemically resistant high impact strength container with ESO protection from preferably $10^{-3}$ to $10^{-11}$. However, in alternate embodiments, any useful or practical material may be used, including any desired plastics and plastic alloys such as a high density polypropolene compound. In some embodiments, various kinds of fibers or other materials may be included in the container 100 to add strength or other desired characteristics. In other alternate embodiments, the materials used in fabrication can be chosen for custom uses, for example, the material used the fabricate the container 100 may be selected for resistance to damage in cold environments or exposure to selected chemicals, such as certain reagents used in the chip fabrication industry, detergents, acids, alkalis, and ultra violet light. The containers 100 may be readily-fabricated in a variety of custom colors, and the colors can be used to color code the containers 100 for easy identification.

In some embodiments written information or labeling can be formed directly in the surface of the carrier during fabrication. For example, in the preferred embodiments seen in FIGS. 1 and 5, opening and closing direction indicators are formed on the flange 154 of the cover.

Figure 11:
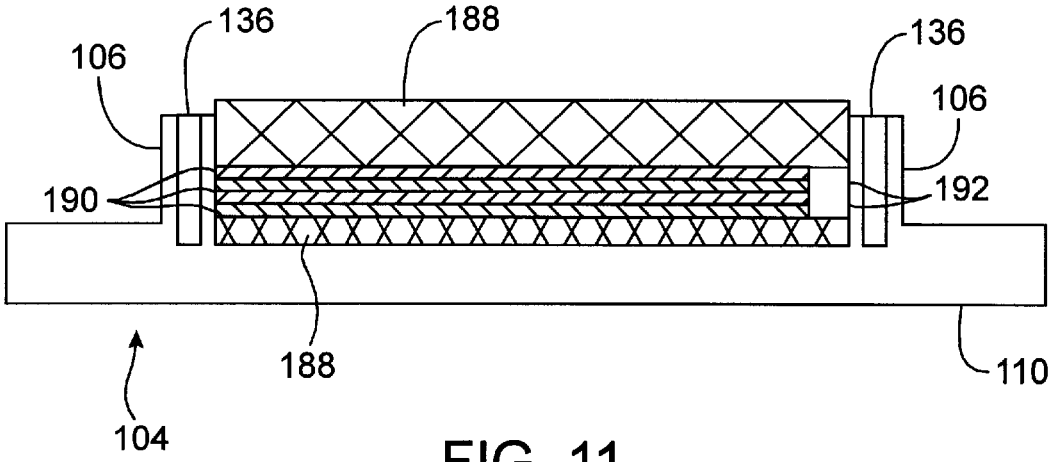
FIG. 11 is a side cutaway view of the container of the invention showing a plurality of discs stacked therein.

FIG. 11 shows a cutaway side view of the container 100. When the container 100 is loaded, one or more layers of compressible material 196 are placed on the bottom of the cylindrical depression 122 of the base 104. Then a wafer 192 is placed on the compressible material 196, followed by another layer or layers of protective material 190.

Figure 12:
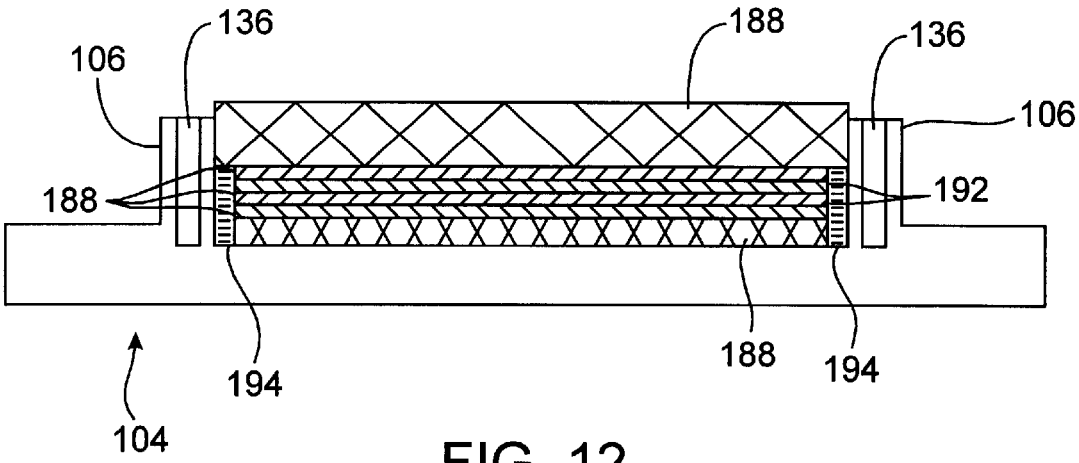
FIG. 12 is a side cutaway view of an alternate embodiment of the container of the invention showing a plurality of discs stacked therein.

Referring to FIG. 11, a preferred stacking scheme is shown including a compressible material 196, such as a urethane foam, placed in the bottom of the cylindrical storage area of the base 104. Then a layer of protective material 190 is placed on top of the compressible material layer 196. A wafer 192 is placed on the protective material 190. The next layers alternate between protective material 190 and wafers 192 until the desired number of wafers 192 are loaded, or until the container 100 is full. An additional layer of compressible material 196 is typically placed on top of the last layer of protective material 190. The compressive material 190 fills any void left between the top of the stack and the underside of the lid 150. To prevent breakage of wafers 192 it is important to overfill the container 100 by ¼ to ½ inch. The overfill created light compression on the wafers 192 when the cover 102 is placed over the base 104. The compression tends to inhibit movement of the wafers 192 inside the container 100 to reduce damage to the wafers 192. FIG. 12 shows an alternate embodiment of the stacking scheme of FIG. 11, wherein a cylindrical foam insert 194 is positioned around the stack of wafers 192. In this embodiment, the diameter of the cylindrical storage area defined by the walls 106 must be increased to accommodate the cylindrical foam insert 194.

The preferred urethane foam has a resistivity around $10^{11}$ Ohms/Sq, and meets MIL-B-81705C static decay requirements. The protective material 190 may comprise a flash-spun and heat-bonded high-density polyethylene (HDPE) fabric that is sold under the tradename TYVEK, cellulose, urethane foam, copper intercept, or a combination of such materials. The most preferred protective material 190 is preferably tear resistant, relatively non-particulating, extremely low in sodium content (preferably below 1 PPM), extremely low in sulfur content (preferably below 1 PPM), and resistant to triboelectric charges. If cellulose discs are used, the discs are preferably 100% laboratory-grade low-lint cellulose with low sodium content (preferably around 169 PPM or less), and low sulfur content (preferably around 15–60 PPM or less). The copper intercept may comprise a copper loaded polyethylene or other material. In alternate embodiments, other materials than those described above may be useable, however, acceptable material will preferably be characterized by being non-corrosive, providing excellent cushion properties, providing ESO protection, and having low particulate generation.

In the preferred embodiments, loading of the container may be done by hand or with robotic assistance. If a robot is used, the robot is preferably configured to lift the wafer using vacuum suction against the upper surface of the wafer. After the container is loaded and closed, it may be desirable to seal the container in an antistatic film and or metalized bag. The containers may also be placed within cushioned packaging for shipping, such as in a box containing foam padding or any other desired packing material.

What is claimed is:

1. A shipping and storage container for holding disk shaped objects, the shipping and storage container comprising:

a base including a deck with at least one wall having an inner circumference defining a roughly cylindrical storage area with a first selected diameter, an outer surface, and at least one gap formed in the wall, the cylindrical storage area configured to store at least one disc shaped object therein, wherein the at least one wall includes four walls with a gap between adjacent walls, each of said four walls including a chamber formed therein and open to the top of the wall, a desiccant placed in the chamber, a cover including a cylindrical recess configured to fit over and around the wall of the base, and a layer of compressible material positioned between an underside of the cylindrical recess and at least one disc shaped object positioned in the cylindrical storage area, the layer of compressible material inhibiting movement of the at least one disc shaped object within the storage area.

2. The shipping and storage container of claim 1, wherein a protective material is placed between each pair of adjacent disc shaped objects.

3. The shipping and storage container of claim 2, wherein the protective material comprises a flash-spun and heat-bonded high-density polyethylene fabric.

4. The shipping and storage container of claim 1, wherein the cover further comprises a square flange formed around the lower edge of the lid of the cover, and wherein the deck of the base is formed in a corresponding square shape.

5. The shipping and storage container of claim 4, further comprising a tamper guard assembly including an aperture formed in the flange of the cover and a corresponding aperture formed in the deck of the base.

6. The shipping and storage container of claim 1, further comprising a protected area formed on a surface of the cover, the protected area configured to hold a data storage media.

7. The shipping and storage container of claim 1, further comprising a locking assembly to prevent accidental opening of the shipping and storage container.

8. The shipping and storage container of claim 7, wherein the locking assembly comprises at least one guide ridge and riser formed on the outer surface of the at least one wall, and at least one corresponding locking tab formed on an inside surface of the cylindrical recess of the lid.

9. A wafer carrier for holding wafers in vertical stacks with lower wafers supporting an underside of upper wafers, the wafer carrier comprising:

a base comprising a deck with at least one wall having an inner circumference defining a roughly cylindrical storage area with a selected diameter, an outer surface, the cylindrical storage area configured to store at least one disc shaped object therein, said at least one wall has a chamber therein, said chamber open to a top of the wall, a desiccant located in said chamber, a cover including a cylindrical recess configured to fit over and around substantially all of the wall of the base, and a layer of compressible material positioned between an underside of the cylindrical recess and at least one disc shaped object positioned in the cylindrical storage area, the layer of compressible material compressing the at least one disc shaped object in the storage area to inhibit movement of the disc shaped object within the storage area, wherein the at least one wall includes four walls with a gap between adjacent walls.

10. The wafer carrier of claim 9, wherein the cylindrical storage area is configured to receive a plurality of disc shaped objects arranged in a vertical stack such that an upper surface of a disc shaped object supports an underside of a disc shaped object positioned thereon.

11. The wafer carrier of claim 10, wherein a protective material is placed between adjacent disc shaped objects.

12. The wafer carrier of claim 9, wherein the layer of compressible material is configurable to fill any void between the underside of the cylindrical recess and the at least one disc shaped object to inhibit movement of disc shaped objects within the cylindrical storage area.

13. The wafer carrier of claim 9, wherein the cover further comprises a square flange formed around a lower edge of the cylindrical recess of the cover, and wherein the deck of the base is formed in a corresponding square shape.

14. The wafer carrier of claim 13, further comprising a tamper guard assembly including an aperture formed in the flange of the cover and a corresponding aperture formed in the deck of the base.

15. The wafer carrier of claim 9, further comprising a locking assembly to inhibit accidental opening of the wafer carrier.

16. The wafer carrier of claim 15, wherein the locking assembly comprises at least one guide ridge and riser formed on the outer surface of the at least one wall, and at least one corresponding locking tab formed on an inside surface of the cylindrical recess of the cover.

17. A shipping and storage container for holding disk shaped objects, the shipping and storage container comprising;

a base including a deck with at least one wall having an inner circumference defining a roughly cylindrical storage area with a first selected diameter, an outer surface, and at least one gap formed in the wall, the cylindrical storage area configured to store at least one disc shaped object therein, said base having a first pattern formed of raised ridges extending downward from a bottom surface of said base, a cover including a cylindrical recess configured to fit over and around the wall of the base, said cover having a second pattern formed of raised ridges extending upward from a top surface of said cover, said ridges sized and configured to interlink with said first pattern on said base, and a layer of compressible material positioned between an underside of the cylindrical recess and at least one disc shaped object positioned in the cylindrical storage area, the layer of compressible material inhibiting movement of the at least one disc shaped object within the storage area, wherein each of said first and second patterns have a square center, three narrow arms and one wide arm.

18. The shipping and storage container of claim 17, further comprising a periphery ridge around a periphery of an outside surface of said cylindrical recess of said cover, wherein said wide arm on said base extends beyond an edge of said cylindrical storage area, wherein said three narrow arms on said base extend partway to an edge of said cylindrical storage area, wherein said wide arm and said narrow arms on said cover extend to said periphery ridge, and wherein said periphery ridge has two notches sized an configured to mate with said wide arm on said base.

19. A wafer carrier for holding wafers in vertical stacks, the wafer carrier comprising:

a base comprising a deck with at least one wall having an inner circumference defining a roughly cylindrical storage area with a selected diameter, an outer surface, the cylindrical storage area configured to store at least one disc shaped object therein, said at least one wall having a chamber therein, said chamber open to a top of the wall, a desiccant located in said chamber, and a cover including a cylindrical recess configured to fit over and around the wall of the base.

20. A shipping and storage container for holding disk shaped objects, the shipping and storage container comprising:

a base comprising a deck with at least one wall having an inner circumference defining a roughly cylindrical storage area with a selected diameter, an outer surface, the cylindrical storage area configured to store at least one disc shaped object therein, said base having a first pattern formed of raised ridges extending downward from a bottom surface of said base, said first pattern having a square center, three narrow arms and one wide arm, a cover including a cylindrical recess configured to fit over and around the wall of the base, said cover having a second pattern formed of raised ridges extending upward from a top surface of said cover, said second pattern having a square center, three narrow arms and one wide arm, said ridges sized and configured to interlink with said first pattern on said base.

* * * * *